US011242653B2

(12) United States Patent
Jackson et al.

(10) Patent No.: US 11,242,653 B2
(45) Date of Patent: Feb. 8, 2022

(54) STRENGTH ADDITIVE SYSTEM AND METHOD FOR MANUFACTURING A WEB COMPRISING CELLULOSIC FIBRES

(71) Applicant: Kemira Oyj, Helsinki (FI)

(72) Inventors: Logan Jackson, Norcross, GA (US); Chen Lu, Marietta, GA (US); Jenna Rabideau, Rydal, GA (US)

(73) Assignee: Kemira Oyj, Helsinki (FI)

( * ) Notice: Subject to any disclaimer, the term of this patent is extended or adjusted under 35 U.S.C. 154(b) by 60 days.

(21) Appl. No.: 16/614,807

(22) PCT Filed: Jun. 15, 2018

(86) PCT No.: PCT/FI2018/050465
§ 371 (c)(1),
(2) Date: Nov. 19, 2019

(87) PCT Pub. No.: WO2018/229345
PCT Pub. Date: Dec. 20, 2018

(65) Prior Publication Data

US 2020/0087859 A1 Mar. 19, 2020

Related U.S. Application Data

(60) Provisional application No. 62/520,657, filed on Jun. 16, 2017.

(30) Foreign Application Priority Data

Jul. 5, 2017 (FI) ..... 20175646

(51) Int. Cl.

| | |
|---|---|
| ***D21H 17/37*** | (2006.01) |
| ***D21H 17/42*** | (2006.01) |
| *D21H 17/28* | (2006.01) |
| *D21H 17/44* | (2006.01) |
| *D21H 17/56* | (2006.01) |
| *D21H 23/04* | (2006.01) |

(52) U.S. Cl.
CPC ..... *D21H 17/37* (2013.01); *D21H 17/42* (2013.01); *D21H 17/28* (2013.01); *D21H 17/44* (2013.01); *D21H 17/56* (2013.01); *D21H 23/04* (2013.01)

(58) Field of Classification Search
USPC ..... 162/168.3
See application file for complete search history.

(56) References Cited

U.S. PATENT DOCUMENTS

| | | | |
|---|---|---|---|
| 3,284,393 | A | 11/1966 | Vanderhoff et al. |
| 4,233,411 | A | 11/1980 | Ballweber et al. |
| 4,605,702 | A | 8/1986 | Guerro et al. |
| 4,650,827 | A | 3/1987 | Becker et al. |
| 4,739,008 | A | 4/1988 | Robinson et al. |
| 5,548,020 | A | 8/1996 | Santini et al. |
| 6,197,919 | B1 | 3/2001 | Crisp et al. |
| 6,939,443 | B2 | 9/2005 | Ryan et al. |
| 7,883,603 | B2 | 2/2011 | Rene et al. |
| 9,328,462 | B2 | 5/2016 | Chen et al. |
| 9,347,181 | B2 | 5/2016 | Oyj |
| 2003/0234089 | A1 | 12/2003 | Michael et al. |
| 2009/0165978 | A1 | 7/2009 | Cornel et al. |
| 2012/0118523 | A1 | 5/2012 | Chen et al. |

FOREIGN PATENT DOCUMENTS

| | | | |
|---|---|---|---|
| CN | 105237648 | A | 1/2016 |
| EP | 0790351 | A2 | 8/1997 |
| GB | 1555340 | A | 11/1979 |
| TW | 510938 | B | 11/2002 |
| WO | 2013192082 | A1 | 12/2013 |
| WO | 2015075318 | A1 | 5/2015 |
| WO | 2016034776 | A1 | 3/2016 |
| WO | 2016085836 | A1 | 6/2016 |

OTHER PUBLICATIONS

Finnish Patent and Registration Office, Search Report of FI20175646, dated Feb. 7, 2018, 1 page.

*Primary Examiner* — Mark Halpern
(74) *Attorney, Agent, or Firm* — Meunier Carlin & Curfman LLC

(57) ABSTRACT

A strength additive system for manufacturing paper, board, tissue or the like includes preferably as separate components, a cationic strength agent, such as a cationic polymer with aldehyde functional groups, and an anionic copolymer obtained by polymerization of a reaction mixture including (meth)acrylamide and anionic monomers, the standard viscosity of the obtained copolymer being in a range of 1.5-5.0 mPas. A method for manufacturing of a paper, board, tissue or the like is further disclosed.

18 Claims, No Drawings

STRENGTH ADDITIVE SYSTEM AND METHOD FOR MANUFACTURING A WEB COMPRISING CELLULOSIC FIBRES

PRIORITY

This application is a U.S. national application of the international application number PCT/FI2018/050465 filed on Jun. 15, 2018 and claiming priority of provisional application 62/520,657 filed on Jun. 16, 2017 and Finnish application 20175646 filed on Jul. 5, 2017 the contents of all of which are incorporated herein by reference.

The present invention relates to a strength additive system and method for manufacturing paper, board, tissue or the like, i.e. a web comprising cellulosic fibers, according to the preambles of the enclosed independent claims.

Glyoxylated polyacrylamide is used in manufacture of paper, board, tissue or the like to enhance the dry and temporary wet strength of the produced paper, board or tissue. Glyoxylated polyacrylamide is used, for example, to increase the initial wet strength of many household tissues which come in contact with water in use. The initial wet strength obtained by use of glyoxylated polyacrylamide is typically temporary, i.e. the wet strength of the product decreases or disappears as function of time when the product comes into contact with water. Temporary wet strength is important for all paper products disposed after use into septic systems, to avoid clogging of those systems. Temporary wet strength is important also for paper products to be recycled, facilitating repulping in less harsh conditions and with lower energy consumption. Flushability or repulpability are the main reasons why manufacturers are increasingly using temporary wet strength additives to provide wet strength that is sufficient for the intended use, but which then decays upon contact with water.

Glyoxylated polyacrylamide is also applied to increase the compression strength and the dimensional stability of many board-grade paper products. However, alkaline pH and/or high alkalinity levels (e.g. >30 ppm) in the manufacturing process may negatively affect the performance of glyoxylated polyacrylamide, even resulting in low or negligent strength enhancement.

Glyoxylated polyacrylamide may be used together with anionic strength agents, such as carboxymethyl cellulose or strength grade anionic polyacrylamide with low molecular weight. However, when used at addition levels, which provide strength improvement these anionic strength agents may lead to poor drainage or remain unretained, thus ending up in the circulating waters. On the other hand, high molecular weight anionic polyacrylamide may be used at low dosages to improve retention or drainage, but an increased dosage level may cause overflocculation of the fiber stock, which may lead to poor formation. Consequently, there is a desire for new alternative strength additive systems, which can provide an enhancement in dry and/or temporary wet strength of the produced paper, board, tissue or the like, and at the same time still improve the drainage.

An object of this invention is to minimise or possibly even eliminate the disadvantages existing in the prior art.

Another object of the present invention is to provide a strength additive system that provides enhancement both in drainage of the web as well as in initial wet strength and dry tensile strength properties of the produced fibre product.

These objects are attained with the invention having the characteristics presented below in the characterising parts of the independent claims. Some preferred embodiments of the invention are presented in the dependent claims.

The embodiments mentioned in this text relate, whenever applicable, to all aspects of the invention, even if this is not always separately mentioned.

A typical strength additive system according to the present invention for manufacturing paper, board, tissue or the like, i.e. a web comprising cellulosic fibers, comprises, preferably as separate components,

- a cationic strength agent, such as a cationic polymer with aldehyde functional groups, for example glyoxalated cationic polyacrylamide or cationic aldehyde starch, such as glyoxalated cationic starch, and
- an anionic copolymer obtained by polymerization of a reaction mixture comprising (meth)acrylamide and anionic monomers, the standard viscosity of the obtained copolymer being in the range of 1.5-5.0 mPas.

A typical method according to the present invention for manufacturing paper, board, tissue or the like, comprises

- obtaining a stock comprising cellulosic fibers,
- adding to the stock a strength additive system according to the invention and comprising a cationic strength agent, such as a cationic polymer and an anionic copolymer,
- forming a web from the stock and drying the web.

Now it has been surprisingly found that a two-component strength additive system comprising both a cationic strength agent, such as a cationic polymer with aldehyde functional groups, and a carefully specified anionic copolymer is able to provide improved dry tensile strength and other strength properties, e.g. initial wet strength properties, for the produced fiber product. Conventionally it is assumed that the addition of anionic strength polymers decreases the drainage. However, it has been unexpectedly observed that the drainage during the manufacture of fiber web is simultaneously maintained at the acceptable level or even improved. It has especially found that when the standard viscosity of the obtained copolymer is in the range of 1.5-5.0 mPas the known problems are reduced and unexpected advantages both in drainage and the tensile strength properties may be achieved. The strength additive system shows also good tolerance for alkaline environment and elevated alkalinity, which makes it suitable also for processes using recycled fibers.

Further, when the strength additive system of the present invention is used, it may be possible to observe positive effects in one or more of the following properties of the produced fiber product: surface strength, SCT/STFI (Short Span Compression Test) strength, bending stiffness, burst strength, ring crush strength, Z-directional tensile strength, Scott bond and/or ply bond.

In the present context the strength additive system is understood as a combination of chemicals, which are used together to provide an advantageous effect in view of the described process and/or product properties, especially drainage and the tensile strength.

According to one preferable embodiment of the invention the anionic copolymer may have the standard viscosity, SV, in the range of 1.6-4.5 mPas, preferably 1.7-4.0 mPas, more preferably 1.8-3.0 mPas, sometimes even 1.9-3.0 mPas or 2.0-2.5 mPas. All standard viscosities given in this application are measured from 0.1 weight-% polymer solution in 1 M NaCl at 25° C. using Brookfield viscometer with a UL adapter at 60 rpm, if not otherwise stated. The standard viscosity of the copolymer corresponds to the length and/or weight of the polymer chains in the copolymer. It has been observed that these viscosity ranges provide good results both in view of drainage and tensile strength, and the viscosity of the polymer is still within the range which guarantee its easy handling, application and use in an industrial process, such as papermaking process.

The anionic copolymer is obtained by free-radical polymerization of a reaction mixture comprising (meth)acrylamide and anionic monomers. Preferably the anionic monomers may be selected from group comprising acrylic acid, methacrylic acid, maleic acid, fumaric acid, itaconic acid, aconitic acid, mesaconic acid, citraconic acid, crotonic acid, isocrotonic acid, angelic acid, tiglic acid, vinylsulphonic acid, allylsulphonic acid, methallylsulphonic acid, styrenesulphonic acid, 2-acrylamido-2-phenylpropanesulfonic acid, 2-acrylamido-2-methylpropanesulfonic acid, their salts and any combination thereof. Even more preferably the anionic monomers are selected from monocarboxylic acids, such as acrylic acid and methacrylic acid, still more preferably anionic monomer is acrylic acid. The reaction mixture for the anionic copolymer may comprise 1-90 mol-%, preferably 3-70 mol-%, more preferably 7-50 mol-%, of anionic monomers.

The anionic copolymer may also contain cationic groups, as long as the net charge of the copolymer is anionic.

According to one embodiment of the invention the anionic copolymer has an anionic charge density in the range of 0.1-10 meq/g dry copolymer, preferably 0.5-8.0 meq/g dry copolymer, more preferably 1.0-4.0 meq/g dry copolymer, sometimes even 1.0-3.5 meq/g dry copolymer, at pH 8.0. The charge density may be measured for example by charge titration using Mütek PCD after adjusting pH of the copolymer to 8.0. It has been observed that these charge density values are able to strengthen the optimal combination of the desired effects, i.e. drainage and initial tensile and dry strength of the produced fiber product.

According to one preferable embodiment of the invention the anionic copolymer may have an anionic charge density in the range of 1.0-4.0 meq/g dry polymer, at pH 8.0, and/or a standard viscosity in the range of 1.7-4.0 mPas, preferably 1.8-3.0 mPas, measured from 0.1 weight-% polymer solution in 1 M NaCl at 25° C. using Brookfield viscometer with a UL adapter at 60 rpm. This anionic copolymer, especially the combination of anionic charge density and standard viscosity, may provide the strength additive system with an excellent combined efficiency in dry strength, initial wet strength, as well as in drainage.

The anionic copolymer is preferably obtained by inverse emulsion polymerization, gel polymerization or precipitation polymerization. Procedures for inverse emulsion polymerization, gel polymerization and precipitation polymerization for manufacture of anionic copolymer of polyacrylamide are known as such for a person skilled in the art. These polymerization methods are advantageous, as they effectively provide anionic copolymers that have the required standard viscosity and are easy to handle at commercially relevant concentration levels, even in industrial scale. According to one preferable embodiment the anionic copolymer may be obtained by inverse emulsion polymerization. With this polymerization method it is possible to produce copolymers inside the whole range of the desired standard viscosity, while maintaining the production costs relatively low and achieving a relatively high polymer content. Furthermore, anionic copolymers obtained by inverse emulsion polymerization are easily dissolved.

The strength additive system comprises further a cationic strength agent. The cationic strength agent can be selected from cationic reactive strength polymers as well as other cationic strength agents that improve or enhance the strength effect obtainable by the anionic copolymer. In the present context "reactive strength agent" is understood as a strength agent that is capable of forming covalent bonds with the other components of the stock, e.g. fibers.

According to one embodiment the system comprises at least one cationic strength agent, which may be selected from alum, polyaluminium chloride, polyvinylamine (PVAm), polyethylene imine (PEI), homopolymers or copolymers of diallyldimethylammonium chloride (DADMAC), polyamine, cationic polyacrylamide-based solution polymers, cationic starches, or any combinations thereof.

According to another embodiment of the present invention the cationic strength agent may comprise a cationic reactive strength polymer, which may be selected polyamidoamine-epichlorohydrin resins, cationic polymers with aldehyde functional groups, urea formaldehyde resins, and melamine formaldehyde resins, or any combinations thereof. The cationic strength agent may also be a combination of one or more cationic reactive strength polymer(s) and one or more other cationic strength agents.

The strength additive system preferably comprises at least one cationic strength agent, which is a cationic reactive strength polymer with aldehyde functional groups, such as glyoxalated cationic polyacrylamide or cationic aldehyde starch, such as glyoxalated cationic starch.

According to one preferable embodiment the strength additive system comprises at least cationic reactive strength polymer, which is a glyoxylated cationic polyacrylamide, which is obtained by polymerization of polymerization mixture of acrylamide monomers and cationic monomers. In the present context the term "acrylamide monomer" encompasses not only acrylamide, but also other amide-containing monomers, such as methacrylamide, ethylacrylamide, N-ethyl methacrylamide, N-butyl methacrylamide or N-ethyl methacrylamide and combinations thereof. Preferably acrylamide monomer is acrylamide. The amount of acrylamide monomers in the polymerization mixture may be in the range of 20-95 weight-%, preferably 30-85 weight-%, calculated from the total weight of the monomers in the polymerization mixture.

When the cationic reactive strength polymer is a glyoxylated cationic polyacrylamide the cationic monomer may be selected from a group consisting of allyl amine; vinyl amine; dialkylaminoalkyl (meth)acrylates and their quaternary or acid salts, such as dimethylaminoethyl acrylate methyl chloride quaternary salt (DMAEA.MCQ), dimethylaminoethyl acrylate methyl sulfate quaternary salt, dimethyaminoethyl acrylate benzyl chloride quaternary salt, dimethylaminoethyl acrylate sulfuric acid salt, dimethylaminoethyl acrylate hydrochloric acid salt, dimethylaminoethyl methacrylate methyl chloride quaternary salt, dimethylaminoethyl methacrylate methyl sulfate quaternary salt, dimethylaminoethyl methacrylate benzyl chloride quaternary salt, dimethylaminoethyl methacrylate sulfuric acid salt, dimethylaminoethyl and methacrylate hydrochloric acid salt; dialkylaminoalkyl (meth)acrylamides and their quaternary or acid salts, such as acrylamidepropyltri-methylammonium chloride, dimethylaminopropyl acrylamide methyl sulfate quaternary salt, dimethylaminopropyl acrylamide sulfuric acid salt, dimethylaminopropyl acrylamide hydrochloric acid salt, methacrylamidopropyltrimethylammonium chloride, dimethylaminopropyl methacrylamide methyl sulfate quaternary salt, dimethylaminopropyl methacrylamide sulfuric acid salt, dimethylaminopropyl methacrylamide hydrochloric acid salt; diethylaminoethylacrylate, diethylaminoethylmethacrylate and diallyldiethylammonium chloride; and any combinations thereof. In general, alkyl groups may be C1-C4 alkyl groups.

When the cationic reactive strength polymer is a glyoxylated cationic polyacrylamide the cationic monomer may further be selected from a group consisting of diallyl dimethyl ammonium chloride (DADMAC), 2-vinylpyridine, 4-vinylpyridine, 2-methyl-5-vinyl pyridine, 2-vinyl-N-methylpyridinium chloride, p-vinylphenyltrimethylammonium chloride, p-vinylbenzyltrimethyammonium chloride, 2-(dimethylamino)ethyl methacrylate, trimethyl(p-vinylbenzyl)ammonium chloride, p-dimethylaminoethylstyrene, dimethylaminopropyl acrylamide, 2-methylacroyloxy-ethyltrimethyl ammonium methylsulfate, 3-acrylamido-3-methylbutyl trimethyl ammonium chloride, 2-(dimethylamino)ethyl acrylate, [2-(acrylamido)ethyl]-trimethylammonium chloride, [2-(methacrylamido)ethyl] trimethylammonium chloride, [3-(acrylamido)propyl]-trimethylammonium chloride, [3-(methacrylamido)-propyl] trimethylammonium chloride, N-methyl-2-vinylpyridinium, N-methyl-4-vinylpyridinium, [2-(acryloyloxy)ethyl]trimethylammonium chloride, [2-(meth-acryloyloxy)ethyl]trimethylammonium chloride, [3-(acryloyloxy)propyl]tri methylammonium chloride, [3-(methacryloyloxy)propyl] trimethylammonium chloride and any combinations thereof.

The glyoxylated cationic polyacrylamide may comprise only one type of cationic monomers, or it may comprise more than one type of cationic monomers. The glyoxylated cationic polyacrylamide may further comprise anionic groups, i.e. groups that originate from anionic monomers, as long as the net charge of the polymer is cationic. The amount of the cationic monomers in the polymerization mixture may be in the range of 10-90 weight-%, preferably 20-70 weight-%.

According to one preferable embodiment the cationic reactive strength polymer is glyoxylated cationic polyacrylamide obtained by polymerization of acrylamide and diallyldimethylammonium chloride (DADMAC).

According to one embodiment of the invention the cationic strength agent, especially the cationic reactive strength polymer, may have a charge density of 0.1-5.5 meq/g dry polymer, preferably 0.3-4.5 meq/g dry polymer, more preferably 0.5-3.0 meq/g dry polymer, sometimes 1.2-2.7 meq/g dry polymer. These charge density values are able to strengthen the optimal combination of the desired effects, i.e. drainage and initial tensile and dry strength of the produced fiber product.

Preparation of cationic reactive strength polymers with aldehyde functional groups is known as such. Polymers can be prepared by reacting a polymer including one or more hydroxyl, amine or amide groups with one or more aldehydes. For example, glyoxalated cationic polyacrylamide can be prepared by reacting glyoxal with a cationic copolymer of polyacrylamide in slightly alkaline aqueous solution and stabilizing under acidic conditions. For glyoxalated polyacrylamide the ratio of the number of substituted glyoxal groups to the number of glyoxal-reactive amide groups may be in excess of 0.03:1, preferably in excess of 0.10:1, more preferably in excess of 0.15:1.

According to one embodiment of the invention the cationic reactive strength polymer may be or comprise cationic aldehyde starch. Cationic aldehyde starches are useful wet-end additives for providing temporary wet strength to paper. They may be produced by a variety of methods, for example by treating cationic starch with glyoxal, by periodic acid oxidation of tertiary amino or quaternary ammonium starches, by treating aldehyde-functionalized starches with hydrazine or hydrazide compounds containing tertiary amino or quaternary ammonium groups in slurry or dispersion reaction, by reacting aldehyde-functionalized starch with aminoguanidine salts, or by autoclave reactions of aldehyde-functionalized starch with ammonia or dimethylamine.

The strength additive system may comprise 5-95 weight-%, preferably 10-70 weight-%, more preferably 20-50 weight-%, of the cationic strength agent, such as cationic reactive strength polymer, and 5-95 weight-%, preferably 10-70 weight-%, more preferably 20-50 weight-%, of the anionic copolymer. The strength additive system may have anionic or cationic net charge. According to one preferable embodiment the strength additive system has net cationic charge, as it has been observed that the cationic net charge provides an effective improvement in tensile strength values as well as good drainage. However, similar benefits are also obtained with the strength additive systems having anionic net charge. According another embodiment the system has anionic net charge.

The strength additive system may also comprise other additional cationic polymers in addition to cationic strength agents, such as cationic reactive strength polymers with aldehyde functional groups, such as polyamine, polyamidoamine, polyamidoamine epichlorohydrin, polyvinylamine, polyethyleneimine, homo- or copolymers of diallyldimethylammonium chloride (DADMAC), and/or cationic polyacrylamide.

The components of the strength additive system are preferably added as aqueous solutions.

According to one embodiment of the strength additive system is a two-component system in the sense that the number of strength agents is two. The system may comprise other polymers and components, which are added to enhance other process properties and/or product properties than strength.

According to the invention the strength additive system is added to the aqueous stock comprising cellulosic fibers. The components of the strength additive system may be added to the stock at any suitable wet end location, for example to thick stock, such as stock having consistency of at least 20 g/l, or to thin stock, such as stock having consistency of less than 20 g/l. Examples of suitable locations include before or after refining the pulp, at the fan pump, after the fan pump, after the deculator, after the screen, e.g. before or at the head box.

According to one embodiment of the invention the cationic strength agent, such as cationic reactive strength polymer, and the anionic copolymer of the strength additive system are added separately to the stock. The components can be added successively, in whichever order, or alternatively, the cationic strength agent and the anionic copolymer of the strength additive system may be added simultaneously, but separately to the stock. The components, i.e. the cationic strength agent and the anionic copolymer, of the strength additive system may be added to the thick stock or to the thin stock, or one of the components is added to the thick stock and another to the thin stock.

According to one preferable embodiment at least part of the cationic strength agent, such as cationic reactive strength polymer, and/or at least part of the anionic copolymer of the strength additive system is added to the thin stock, preferably after the fan pump or after the deculator, or more preferably after the screen. This embodiment provides an improved strength performance, or alternatively the same strength specifications may be achieved by using reduced dosage of the cationic strength agent and/or of the anionic copolymer, especially when the addition is after the screen. Also the retention and drainage performance may be further improved when at least part of the cationic polymer and/or at least part of the anionic copolymer of the strength additive system is added to the thin stock, especially after the screen. The exact mechanism is not fully understood but it is assumed, without wishing to be bound by a theory, that improved retention of fines may participate in the improved strength performance in these embodiments. In some embodiments all of the cationic strength agent and/or all of the anionic copolymer of the strength additive system is added to the thin stock.

The cationic strength agent, for example cationic reactive strength polymer, may be added in amount of 0.5-40 lb/ton, preferably 1-30 lb/ton, more preferably 1.5-20 lb/ton, even more preferably 2-15 lb/ton, and the anionic copolymer of the strength additive system is added in amount of 0.1-20 lb/ton, preferably 0.2-15 lb/ton, more preferably 0.3-10 lb/ton.

The strength additive system and the method according to the present invention may be utilized in manufacture of most of the paper grades, for example in tissue, packaging board, newsprint, and printing/writing papers, to improve tensile, burst and surface strength. The strength additive system and the method are especially suitable for the manufacturing processes, where the fiber stock has an elevated pH and an elevated alkalinity value. The pH of the fiber stock may be over 6.5, for example at least 7.0, or sometimes even over 7.5. In the present context the elevated alkalinity refers to alkalinity of at least 30 ppm, such as over 60 ppm, for example at least over 90 ppm, expressed as $CaCO_3$. Alkalinity is the name given to the quantitative capacity of an aqueous solution to neutralize an acid. Alkalinity may affect the polymer performance as it changes the pH of the solution and increases ionicity of the solution as the ionisable groups are mainly deprotonated at elevated alkalinity.

The strength additive system is suitable for any kind of cellulosic fibers, which can be obtained by mechanical, chemical or semichemical pulping methods. The cellulosic fibers may comprise any cellulosic or lignocellulosic fibers separated e.g. from wood, cotton, flax, hemp, jute, ramie, kenaf, abaca, or sisal, or fibers of regenerated cellulose such as rayon, lyocell, viscose. The cellulosic fibers may be bleached, unbleached, or a combination thereof. The fibers can also be obtained from recycled paper or pulp, for example from broke or old corrugated containers (OCC), or mixtures of such pulps, and the like. In addition to cellulosic fibers, the paper products may comprise non-cellulosic polymeric fibers, such as fibers of polyethylene, polypropylene, or polyester, in the form of e.g. single component or bicomponent fibers.

The produced fiber product that is obtained may be for example paper sheeting, paperboard, tissue paper, or wall board. Paper products include for example all grades of paper, newsprint, linerboard, fluting medium, and Kraft, and other paper materials. Specific examples of the tissue papers include hygienic tissue paper, facial tissues, paper towels, wrapping tissue, toilet tissue, table napkins and the like.

EXPERIMENTAL

Determination of Polymer Molecular Weight by Standard Viscosity (SV)

The molecular weight of a polymer may be determined by viscometric methods such as Standard Viscosity ("SV", also known as "Solution Viscosity"), or Intrinsic Viscosity ("IV"). Both of these processes are well-known to persons of ordinary skill in the art.

It is also well known in the art that the intrinsic viscosity of a polymer correlates to the molecular weight of that polymer using the Formula (1):

$$IV=0.000373\times\text{molecular weight}^{0.66} \quad (1)$$

Intrinsic viscosity is a cumbersome and time consuming property to measure, however. IV measurement is commonly taken with a Cannon-Ubbelohde capillary viscometer at various concentrations of, for instance, 100, 250, 500 and 1,000 ppm in 1 molar sodium chloride at 30° C. and at shear rates ranging between 50-1000 $sec^{-1}$. The data thus obtained is subjected to linear regression to extrapolate it to zero shear rate and zero polymer concentration. The value obtained with this calculation is the intrinsic viscosity of the polymer.

Standard (i.e. solution) viscosity SV values are relatively easier, i.e., less cumbersome and time consuming, to obtain than intrinsic viscosity values. Moreover, SV values can be correlated to IV values for a particular polymer. Thus, polymeric molecular weights can be approximated by reference to the solution viscosity of the polymer. That is, the higher the SV value for a particular polymer, the higher its molecular weight. For example (the following values are approximate):

SV 4 mPas=IV 15 dl/g.=MW 10,000,000
SV 5 mPas=IV 25 dl/g.=MW 20,000,000
SV 6 mPas=1V 30 dl/g.=MW 26,000,000
SV 7 mPas=IV 32 dl/g.=MW 30,000,000

For purposes of the present invention, SV values are determined using a 0.1 weight-% polymer solution in 1 molar NaCl at 25° C. The measurement is taken using a Brookfield viscometer with a UL adapter at 60 rpm when the SV is 10 or less.

Thus although one can calculate with a high degree of exactitude the molecular weight of a polymer within a solution using the IV value of the subject polymer with the Formula 1 provided above, the difficulty in obtaining these IV values, in terms of time and attention to detail required, is outweighed by the relative ease of using SV values for this purpose. This is because such SV values are relatively simple to obtain and may be mathematically correlated to corresponding IV values, thus permitting one to obtain a rough determination of the polymer's molecular weight based upon the SV value of the solution alone. IV and polymer's approximate molecular weight can be estimated from SV by assuming a linear relationship of two extremes and then using Formula 1 hereinabove.

Materials

GPAM1 was a cationic glyoxalated polyacrylamide sample having charge density of about 1.8 meq/g dry polymer, prepared by the crosslinking reaction between a poly(acrylamide-co-dimethyldiallylammonium chloride) base polymer and glyoxal as discussed e.g. in U.S. Pat. No. 4,605,702. Anionic polyacrylamide (APAM) samples A through D were copolymers of acrylamide and sodium acrylate prepared by inverse emulsion polymerization as discussed in U.S. Pat. Nos. 3,284,393; 4,650,827; 4,739,008 and 5,548,020. Anionic polyacrylamide E was a copolymer of acrylamide and sodium acrylate prepared by standard aqueous solution polymerization as well known by the persons of ordinary skills in the art. One example of such polymerization was discussed in U.S. Pat. No. 6,939,443. Sample E had a final polymer content of 20% and viscosity of 9000 mPas at room temperature. All APAM samples from A through E had an anionic charge density of 20 mol-%. The SV values of all APAM samples are shown in Table 1.

Handsheet Preparation

Handsheets were prepared using a pulp mixture (2.5 weight-%) of virgin bleached hardwood (50%) and virgin bleached softwood (50%). The Canadian Standard Freeness of the mixture was 450 ml. Pulp dilutions during handsheet preparation were carried out using a specially formulated water to simulate papermaking mill white water. This formulated water contained 150 ppm of sodium sulfate, 35 ppm of calcium chloride, and 100 ppm alkalinity (adjusted by sodium bicarbonate). The final pH was adjusted to 7.8 using dilute hydrochloric acid and sodium hydroxide. The pulp suspension was first diluted to 0.4 weight-%. While mixing with an overhead agitator, GPAM1 and APAM samples were added to the pulp suspension consecutively with a time interval of 30 seconds. After additional two minutes of mixing, the treated pulp suspension were added a standard (8"×8") Nobel & Woods handsheet mold to produce 3 g sheets of paper to target a basis weight of 52 lbs/3470 $ft^2$. Next, the handsheets were pressed between felts in the nip of a pneumatic roll press at about 15 psig and dried on a rotary dryer at 110° C. The paper samples were oven cured for 10 minutes at the temperature of 110° C., then conditioned in the standard TAPPI control room for overnight.

Dry Tensile Strength Test

Tensile strength is measured by applying a constant-rate-of-elongation to a sample and recording the force per unit width required to break a specimen. This procedure references TAPPI Test Method T494 (2001), and modified as described.

Initial Wet Tensile Strength Test

Initial wet tensile strength test method is used to determine the initial wet tensile strength of paper or paperboard that has been in contact with water for 2 seconds. A 1-inch wide paper strip sample is placed in the tensile testing machine and wetted on both strip sides with deionized water by a paint brush. After the contact time of 2 seconds, the strip is elongated as set forth in 6.8-6.10 TAPPI test method 494 (2001). The initial wet tensile is useful in the evaluation of the performance characteristics of tissue product, paper towels and other papers subjected to stress during processing or use while instantly wet. This method references U.S. Pat. No. 4,233,411, and modified as described.

Drainage Test

Pulp furnishes containing about 3.5% dry mass were obtained from a packaging paperboard machine and diluted with white water from the same machine to a final 1.0% dry mass. pH was adjusted to 7.5 using 0.5 N of sodium hydroxide or hydrochloric acid. The addition dosages of glyoxalated polyacrylamide and anionic polyacrylamide were based on dry chemical mass and dry fiber mass. A dynamic drainage analyzer (DDA) (AB Akribi Kemikonsulter) was used for the evaluation. 800 mL of diluted pulp furnish was first placed into DDA. Then, chemicals were added under mixing. Detailed contact time and chemical addition sequence are shown as follow:

| | |
|---|---|
| 0 seconds | started the stirrer at 950 rpm |
| 10 seconds | added GPAM1 and adjusted to 1400 rpm |
| 20 seconds | added APAM |
| 28 seconds | adjusted to 950 rpm |
| 35 seconds | stopped the stirrer |

After the stirrer stops, the treated pulp was filter through a 50-mesh screen under 165 mbar vacuum. The amount of time required to break the vacuum was recorded as an indication of drainage rate. A shorter time suggested a faster drainage rate.

TABLE 1

SV values of APAM samples

| Sample | SV (mPas) |
|---|---|
| A | 3.4 |
| B | 2.3 |
| C | 1.9 |
| D | 1.7 |
| E (ref.) | 1.2 |

TABLE 2

Paper tensile properties

| Example | GPAM (8 lb/ton) | APAM (4 lb/ton) | Dry tensile | Initial wet tensile |
|---|---|---|---|---|
| 1 | GPAM1 | None | 21.7 | 1.2 |
| 2 | GPAM1 | A | 30.4 | 3.5 |
| 3 | GPAM1 | B | 33.2 | 3.8 |
| 4 | GPAM1 | C | 33.2 | 3.9 |
| 5 | GPAM1 | D | 31 | 4.2 |
| 6 | GPAM1 | E | 28.5 | 3.2 |

TABLE 3

Drainage test

| Examples | GPAM (8 lb/ton) | APAM (1 lb/ton) | Drainage time (s) |
|---|---|---|---|
| 7 | GPAM1 | None | 26 |
| 8 | GPAM1 | A | 18.9 |
| 9 | GPAM1 | B | 19.2 |
| 10 | GPAM1 | D | 25.3 |
| 11 | GPAM1 | E | 30.8 |

Results and Discussion

The combination of a cationic GPAM and an anionic APAM was reported in U.S. Pat. Nos. 9,347,181 and 9,328,462 to increase paper strength and also improve papermaking retention/drainage process. The APAM samples applied were either very high molecular weight flocculants with a SV of at least 5.5 mPas or low molecular weight strength products with a SV of 1.2 mPas. The HMW flocculants can only be applied at low dosages to improve retention/drainage. Higher HMW flocculant dosages could lead to over-flocculation, poor paper formation, and lower tensile strength. In contrast, low molecular weight strength APAM can be applied at considerable higher dosages to enhance paper strength. However, those low molecular weight strength APAM samples can negatively impact retention/drainage.

In this work we developed new APAM samples with medium SV values to enhance paper strength and improve retention/drainage simultaneously. Table 1 listed five APAM samples with a SV range from 1.2 to 3.4 mPas. Table 2 demonstrates the effect of those APAM samples on paper dry and initial wet strength when used in combination with a cationic GPAM. Surprisingly the two-component program of GPAM and APAM having intermediate SV provided a dry strength local maximum and an initial wet strength local maximum, by slightly different SV values. The best dry and initial wet strength performance combination can be seen in the partially overlapping SV values of 1.7-3.4 mPas, especially around SV 2 mPas. Too high or too low SV values led to the decrease of strength properties. The drainage rate was a function of APAM SV value. Table 4 shows that higher APAM SV value resulted in faster drainage rate. The APAM sample with a SV value of 1.2 led to lower drainage rate than the control test without APAM. Increasing SV value to 2.3 mPas resulted in significant drainage rate increase.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. A strength additive composition for manufacturing paper, board or tissue, the composition comprising as separate components:

a cationic strength agent being a cationic polymer with aldehyde functional groups and having a charge density of 0.1-5.5 meq/g; and an anionic copolymer obtained by polymerization of a reaction mixture comprising (meth)acrylamide and anionic monomers, the standard viscosity of the obtained copolymer being in a range of 1.8-3.0 mPas.

2. The strength additive composition according to claim 1, wherein the reaction mixture for the anionic copolymer comprises 1-90 mol % of anionic monomers.

3. The strength additive composition according to claim 1, wherein the anionic copolymer has an anionic charge density in a range of 0.1-10 meq/g, at pH 8.0.

4. The strength additive composition according to claim 1, wherein the anionic copolymer is obtained by polymerization of a reaction mixture comprising (meth)acrylamide and anionic monomers selected from group consisting of acrylic acid, methacrylic acid, maleic acid, fumaric acid, itaconic acid, aconitic acid, mesaconic acid, citraconic acid, crotonic acid, isocrotonic acid, angelic acid, tiglic acid, vinylsulphonic acid, allyl sulphonic acid, methallylsulphonic acid, styrenesulphonic acid, 2-acrylamido-2-phenylpropanesulfonic acid, 2-acrylamido-2-methylpropanesulfonic acid, their salts and any combinations thereof.

5. The strength additive composition according to claim 1, wherein the anionic copolymer is obtained by inverse emulsion polymerization, gel polymerization or precipitation polymerization.

6. The strength additive composition according to claim 1, wherein the composition comprises at least one cationic strength agent, which is selected from alum, polyaluminium chloride, polyvinylamine (PVAm), polyethylene imine (PEI), homopolymers or copolymers of diallyldimethylammonium chloride (DADMAC), polyamine, cationic polyacrylamide-based solution polymers, cationic starches, or any combinations thereof.

7. The strength additive composition according to claim 1, wherein the cationic strength agent comprises a cationic reactive strength polymer, which is selected polyamidoamine-epichlorohydrin resins, cationic polymers with aldehyde functional groups, urea formaldehyde resins, and melamine formaldehyde resins, or any combinations thereof.

8. The strength additive composition according to claim 1, wherein the composition comprises at least one cationic reactive strength agent, which is a cationic polymer with aldehyde functional groups.

9. The strength additive composition according to claim 8, wherein the cationic reactive strength polymer is a glyoxalated cationic polyacrylamide, which is obtained by polymerization of polymerization mixture of acrylamide monomers and cationic monomers.

10. The strength additive composition according to claim 1, wherein the cationic strength agent has a charge density of 0.3-4.5 meq/g.

11. The strength additive composition according to claim 1, wherein the composition comprises 5-95 weight-%, of the cationic strength agent and 5-95 weight-% of the anionic copolymer.

12. The strength additive composition according to claim 1, wherein the composition has net cationic charge.

13. A method for manufacturing of a paper, board or tissue, the method comprising:

obtaining a stock comprising cellulosic fibers;

adding to the stock the strength additive composition of claim 1; and forming a web from the stock and drying the web.

14. The method according to claim 13, wherein at least part of the cationic strength agent and/or at least part of the anionic copolymer of the strength additive composition is added after a fan pump.

15. The method according to claim 14, wherein at least part of the cationic strength agent and/or at least part of the anionic copolymer of the strength additive composition is added after a screen.

16. The method according to claim 13, wherein the cationic strength agent and the anionic copolymer of the strength additive composition are added separately.

17. The method according to claim 13, wherein the cationic strength agent and the anionic copolymer of the strength additive composition are added simultaneously.

18. The method according to claim 13, wherein the cationic strength agent of the strength additive composition is added in amount of 0.5-40 lb/ton, and the anionic copolymer of the strength additive composition is added in amount of 0.1- 20 lb/ton.

* * * * *